US005228253A

United States Patent [19]

Wattelez

[11] Patent Number: 5,228,253

[45] Date of Patent: Jul. 20, 1993

[54] MODULAR TILE WITH SHOCK ABSORBING PROPERTIES

[75] Inventor: Denis Wattelez, Asnieres, France

[73] Assignee: Usines Gabriel Wattelez S.A., France

[21] Appl. No.: 728,394

[22] Filed: Jul. 11, 1991

[51] Int. Cl.[5] ..... E04C 1/39

[52] U.S. Cl. ..... 52/177; 472/92; 472/94; 52/263

[58] Field of Search ..... 52/177, 181, 263, 126.6; 472/92-94; 428/169; 404/15, 35, 36, 43

[56] References Cited

U.S. PATENT DOCUMENTS

| | | | |
|---|---|---|---|
| 629,951 | 8/1899 | Brown | 52/181 |
| 2,070,839 | 2/1937 | Place | 52/177 |
| 3,199,257 | 8/1965 | Spiselman et al. | 52/126.6 X |
| 4,558,544 | 12/1925 | Albrecht et al. | 52/126.6 |
| 4,727,697 | 3/1988 | Vaux | 52/177 |
| 4,948,116 | 8/1990 | Vaux | 52/177 X |

FOREIGN PATENT DOCUMENTS

| | | | |
|---|---|---|---|
| 208169 | 11/1989 | Japan | 52/177 |
| 901949 | 7/1962 | United Kingdom | 52/177 |
| 1408524 | 10/1975 | United Kingdom | 52/177 |
| 2136472 | 9/1984 | United Kingdom | 52/177 |

*Primary Examiner*—Richard E. Chilcot, Jr.
*Attorney, Agent, or Firm*—William A. Drucker

[57] ABSTRACT

A modular floor tile with shock absorbing properties has a semi rigid cellular structure made up of vertical ribs joined at the top by a horizontal flexible mat and adapted to undergo relative deformation in compression in response to a vertical load.

12 Claims, 2 Drawing Sheets

MODULAR TILE WITH SHOCK ABSORBING PROPERTIES

BACKGROUND OF THE INVENTION

1. Field of the Invention

The present invention concerns a modular tile with shock absorbing properties suitable for sports halls, games areas, places where jumpers land, etc adapted to be placed horizontally and assembled into a floor covering and additionally, in some specific circumstances, to be placed against vertical walls.

2. Description of the Prior Art

Known tiles of this type are in the form of rubber modules designed to cushion impact and to avoid damage resulting from the dropping of metal or other material objects. These modules comprise a shock absorbing sublayer of foam rubber in contact with the floor, for example, and a strengthened impact layer resistant to high pressures and to high shear loads such as occur when heavy objects are dropped.

The floor coverings made form this type of tile are not suitable for the applications mentioned above because the impact layer is too hard should a person or a child fall either accidentally or during a sporting activity. Additionally, these tiles are merely laid on the floor and retained by the side walls of the room or fixed by ragbolts into the floor, but this implies time-consuming and costly handling and labour and damage to the floor. This is not permissible in some cases of temporary use of a room for such activities.

Consideration could, of course, be given to using flexible foam rubber tiles or carpets with no impact layer or a softer impact layer, but this raises another problem as it is not easy to walk or run on a surface that is too flexible.

It is clear that the problem lies in the compromise that has to be found between shock absorbing properties in response to an impact caused by a fall or as the result of a jump and stiffness properties offering normal comfort when a person walks on the floor covering.

An object of the present invention is to remedy these drawbacks.

SUMMARY OF THE INVENTION

The present invention consists in modular tile with shock absorbing properties suitable for sports halls and games areas comprising a semi-rigid cellular structure formed of vertical ribs joined in their upper part by a horizontal flexible mat and adapted to undergo relative deformation in compression in response to a vertical load.

The degree of relative deformation in compression of the vertical ribs is determined by the height of the ribs, their width, their thickness and the nature of the material.

The horizontal flexible mat is advantageously set back from the upper part of the ribs and subdivided into as many parts as there are cells covered, so as to leave exposed a height of the ribs determined by the distance between the upper plane of the part-mat and the apex of said rib. This provides a non-skid surface.

The exposed parts of the ribs preferably delimit with the mat of the cellular housings at the bottom of each of which is provided at least one non-skid pad leaving in said cellular housing at least one liquid flow channel.

According to another feature of the invention, the cellular structure forming said tile is obtained by a single operation of molding an elastomer material into a monoblock unit.

Tiles of this kind are linked together to form a floor covering by a coupling system. A coupling system of this kind for use with the tiles in accordance with the invention preferably comprises four feet the shape and size of which match four corner cells of four cellular structure tiles to be joined, within which they are nested when put into place, said feet being linked by bridges.

A system of this kind is advantageously molded as a monoblock assembly from an elastomer material having the same mechanical properties as the tiles to be joined.

BRIEF DESCRIPTION OF THE DRAWINGS

Other features of the invention will emerge from the following description of the invention given with reference to the appended drawings, in which.

DETAILED DESCRIPTION OF THE INVENTION

Figure 1:
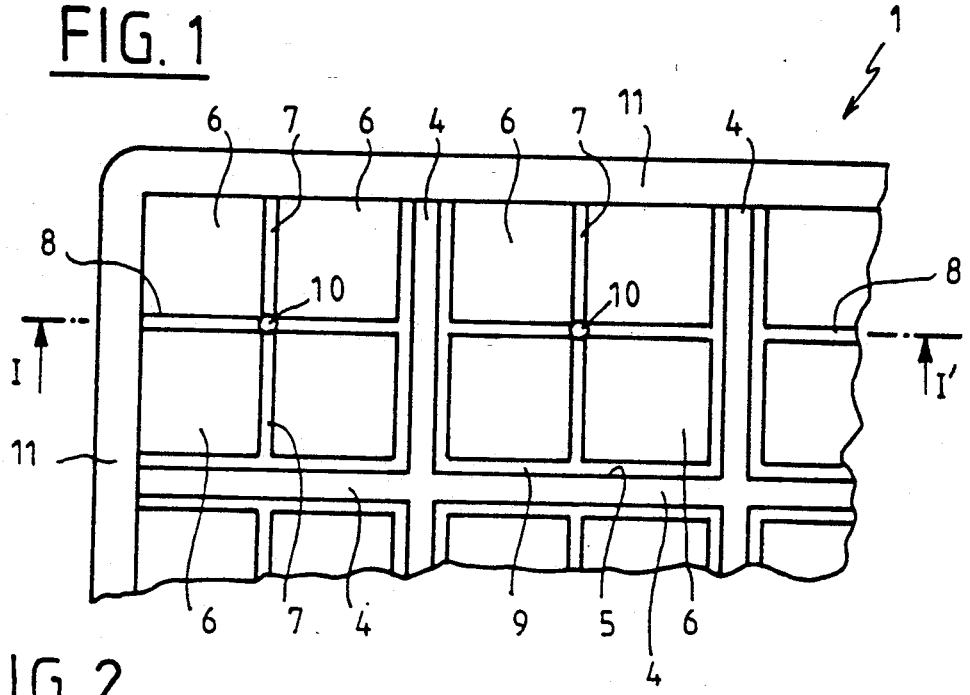
FIG. 1 is a plan view of a part of a tile in accordance with the invention with shock absorbing properties.
Figure 2:
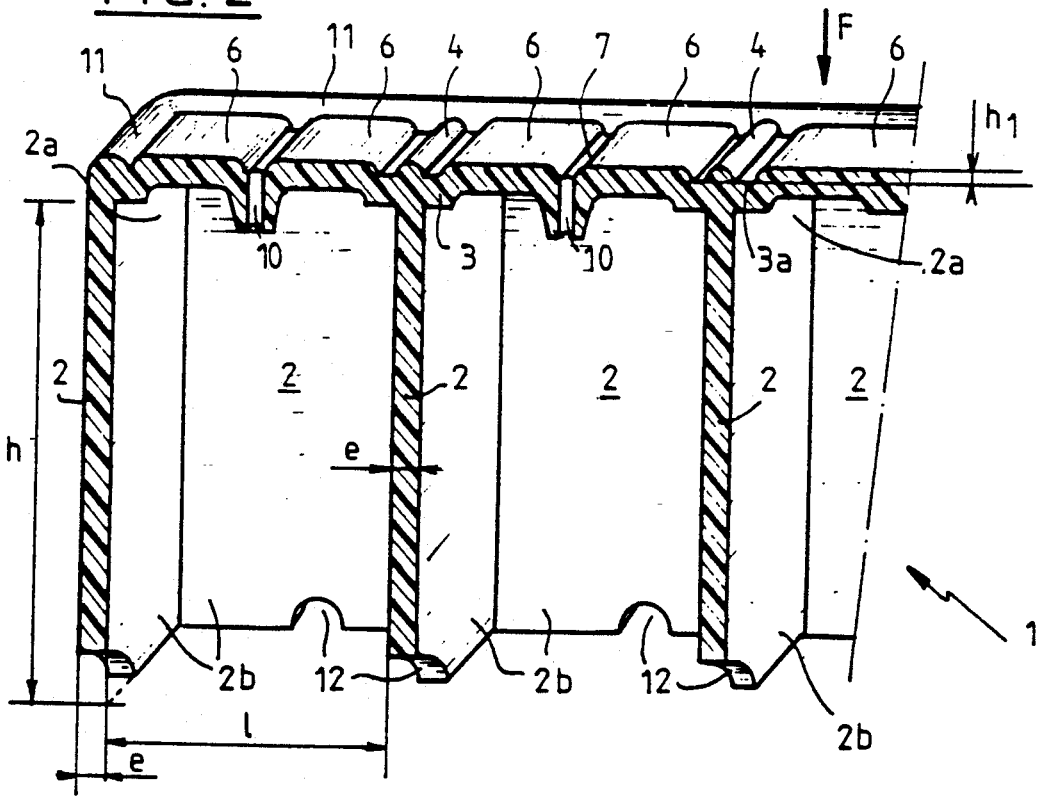
FIG. 2 is a perspective view in cross-section on the line I/I' in FIG. 1.

The tile 1 of which part is shown in FIGS. 1 and 2 comprises a semi-rigid cellular structure made up of vertical ribs 2 crossing at right angles and linked together in their upper part 2*a* by a flexible horizontal mat 3 formed during the same molding operation.

A structure of this kind is adapted to undergo relative deformation in compression, due to a vertical load F, which is determined by the height h of the rib 2, its width l, its thickness e and the nature of the material used.

It has been found that ribs 2 having a height h=35 mm, a width l=20 mm, a thickness e=2 mm and made from a material such as an elastomer material give satisfactory results. A structure in the form of a flexible plane supported vertically by vertical walls, in this instance the ribs 2 which are adapted to buckle under a vertical load F, enables energy absorption of 30 Joules or more in response to an impact of 500 kg over 0 $cm^2$. This corresponds to a man landing on both heels after dropping from a height of 2.50 m. Obviously, if greater heights were to be catered for, the cellular structure would have different dimensions.

In the embodiment shown in the figures, the flexible mat 3 is set back from the upper part 4 of the ribs 2 and is subdivided into as many part-mats 3 as there are cells. The part-mats 3 therefore close off the cells with a height $h_1$ of the rib 2 delimited by the upper planes 3*a* and the apexes 4 of the ribs showing, to constitute advantageously a non-skid surface.

The exposed apexes 4 of the ribs 2 delimit with the mat 3 cellular housings 5 at the bottom of which is molded at least one non-skid pad 6 leaving in each cellular housing 5 at least one liquid flow groove.

In the example shown, there are four square pads 6. They are laid out checkerboard fashion in each cellular housing 5 and delimit between them two perpendicular grooves 7 and 8 which intersect at their center and discharge at their respective ends into a peripheral groove 9 the outer lip of which is defined by the lip of the cellular housing 5, (the apexes 4 of the ribs 2).

A central drainage hole 10 is provided at the intersection of the perpendicular grooves.

Note that the tile comprises a higher outer rim which is rounded to eliminate the step effect.

As shown in FIG. 2, the cellular structure comprises in the lower part 2*b* of the ribs 2 bearing on the floor cut-outs 12 enabling the cells to communicate with each other so that liquid can circulate freely under the floor covering constituted by the tiles 1.

These tiles 1 are molded as monoblock structures from an elastomer material in a single operation. They are linked together to constitute a floor covering by a coupling system generally referenced 20.

Figure 3:
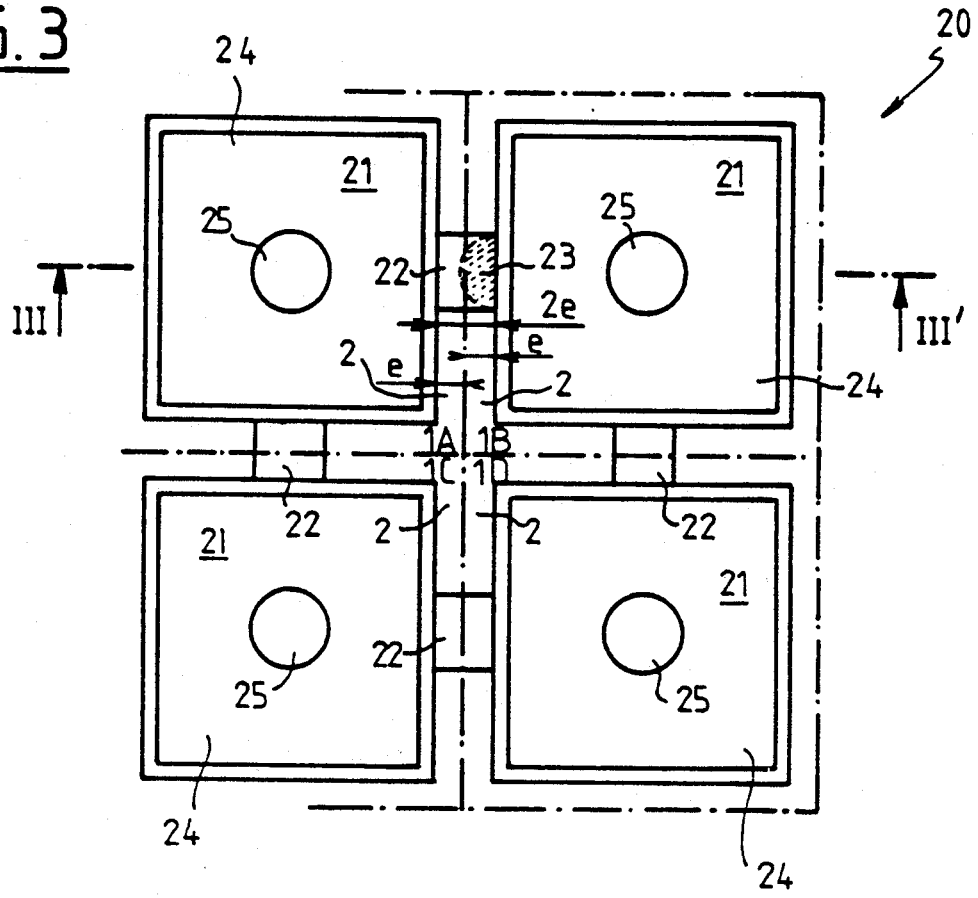
FIG. 3 is a plan view of a tile coupling system in accordance with the invention.
Figure 4:
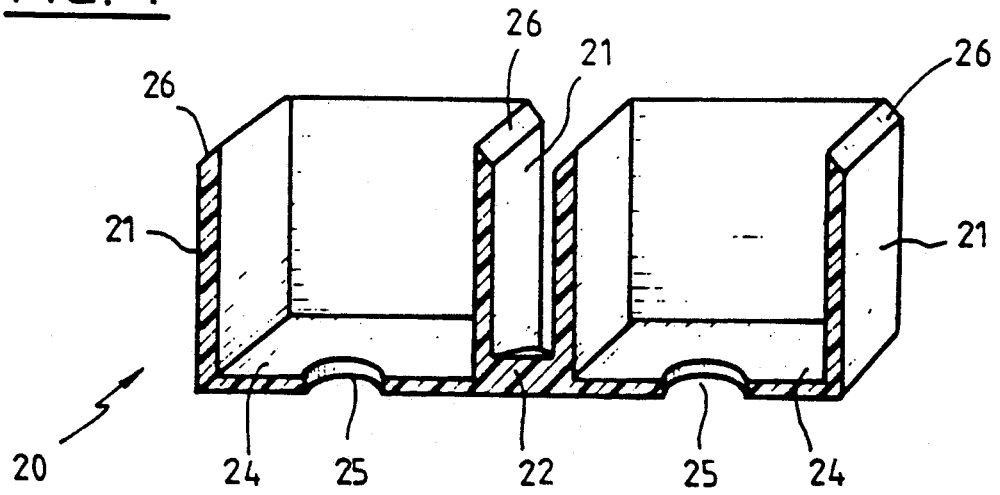
FIG. 4 is a perspective view in cross-section on the line III/III' in FIG. 3.

FIGS. 3 and 4 show such a coupling system 20, comprising four feet 21 whose shape and size match four corner cells of four cellular structure tiles 1A, 1B, 1C, 1D as described above, in which cells the feet 21 are nested when put into place.

The feet 21 are linked by bridges 22 placed at the base of said feet, on their transverse axis and having a cross-section 23 matching the cut-outs 12 formed in the lower part 2*b* of the ribs 2, which therefore straddle them when put into place. The tiles 1A, 1B, 1C, 1D, etc therefore rest on the same floor plane as the systems 20 which link them, ensuring a uniform disposition of the floor covering.

The feet 21 are separated by a distance which is substantially equal to the thicknesses "e" of two ribs 2 of two corner cells of two adjoining floor tiles 1.

A drainage hole 25 is formed at the center of each foot to drain off any liquid that might collect in the bottom 24 of the feet 21.

To facilitate insertion of the feet 21 into the cells of the floor tiles 1, the free ends of said feet 21 are formed with a chamfer 26.

The coupling system 20 just described is molded as a monoblock unit, in a single molding operation, from the same elastomer material as that from which the tile 1 is molded. In this way the feet 21 do not cause harder spots under the tile 1.

A floor covering is readily assembled from tiles 1 of this kind joined with coupling systems 20 of this kind, irrespective of the geometry of the room and of obstacles to be circumvented, such as supporting pillars, for example. A material of this kind can be cut to size and shape as required along the edges of the cells with no detrimental effect on appearance or on the effectiveness of the floor tile concerned, as each cell constituting the floor tile 1 has properties that are entirely independent of the other cells.

I claim:

1. Modular tile with shock absorbing properties suitable for sports halls and games areas having a cellular structure resiliently flexible in compression in response to a vertical load and comprising:

i) vertical walls having respective upper parts ended by apexes, ii) horizontal walls joining said upper parts so as to be set back therefrom and to leave exposed said apexes, said upper parts forming ribs projecting from said horizontal walls so as to constitute a non-skid surface, and iii) cellular housings delimited by said ribs and by said horizontal walls and each having a bottom provided with non-skid pads and at least one liquid flow groove.

2. Modular tile according to claim 1 wherein each of said vertical walls has a height, a width, a thickness and a nature of material which determine a degree of relative deformation in compression.

3. Modular tile according to claim 1 wherein each of said cellular housing has a square shape and comprises in a chequerboard layout four of said non-skid pads which have a quadrangular shape, and which delimit between them two perpendicular grooves which intersect at a center point and which discharge into a peripheral groove adjacent to said ribs.

4. Module tile according to claim 3 wherein a central drainage hole is provided at said center point.

5. Modular tile according to claim 1 comprising a raised peripheral rim which is rounded to eliminate a step effect.

6. Modular tile according to claim 1 wherein said height, width, thickness and nature of material are such as to enable an absorption of at least 30 Joules of energy in response to an impact of 500 kg over 10 $cm^2$.

7. Floor covering with shock absorbing properties suitable for sports halls and games areas, comprising a plurality of modular tiles having a cellular structure resiliently flexible in compression in response to a vertical load and comprising:

i) vertical walls having respective upper parts ended by apexes, ii) horizontal walls joining said upper parts so as to be set back therefrom and to leave exposed said apexes, said upper parts forming ribs projecting from said horizontal walls so as to constitute a non-skid surface, and iii) cellular housings delimited by said ribs and by said horizontal walls and each having a bottom provided with non-skid pads and at least one liquid flow groove, said modular tiles being coupled by a plurality of coupling systems each comprising at least two feet joined by a bridge and nested in two respective cavities provided respectively between said vertical walls of two adjacent tiles.

8. Floor covering according to claim 7 wherein each of said coupling systems is adapted for joining four adjacent tiles, and comprises four feet disposed in a square and joined together by four bridges, said four feet being nested in four respective cavities provided respectively between said vertical walls of said four adjacent tiles.

9. Floor covering according to claim 7 wherein said coupling system and said tiles present a same degree of relative deformation in compression in response to a vertical load and are respectively obtained by a single operation of molding an elastomer material into a monobloc unit.

10. Floor covering according to claim 7 wherein each of said vertical walls has a lower part forming a cut-out, and each of said feet has a base from which extends transversely said bridge which has a cross-section matching said cut-out which straddles said bridge when assembled.

11. Floor covering according to claim 7 wherein said at least two feet are spaced by a distance substantially equal to the thickness of two vertical walls forming said cavities.

12. Floor covering according to claim 10 wherein the base of said feet comprises a liquid drainage hole.

* * * * *